US005350063A

United States Patent [19]

Berdan, II

[11] Patent Number: 5,350,063

[45] Date of Patent: Sep. 27, 1994

[54] CARTWHEELABLE SHIPPING PACKAGE FOR INSULATION

[75] Inventor: Clarke Berdan, II, Granville, Ohio

[73] Assignee: Owens-Corning Fiberglas Technology Inc., Summit, Ill.

[21] Appl. No.: 90,822

[22] Filed: Jul. 13, 1993

[51] Int. Cl.[5] ..... B65D 85/46

[52] U.S. Cl. ..... 206/321; 206/83.5; 206/442; 53/447; 53/528

[58] Field of Search ..... 206/83.5, 321, 322, 206/597, 388, 442, 494, 497; 53/157, 447, 528, 527

[56] References Cited

U.S. PATENT DOCUMENTS

| | | | |
|---|---|---|---|
| 281,490 | 7/1883 | Grader | 206/83.5 |
| 496,042 | 4/1893 | Dederick | 206/83.5 |
| 505,580 | 9/1893 | Watson | 206/83.5 |
| 2,194,451 | 3/1940 | Soubier | 206/499 |
| 2,354,186 | 7/1944 | Donahue | 206/321 |
| 3,407,562 | 10/1968 | DiNicola | 53/528 |
| 3,471,989 | 10/1969 | Carliss | 53/447 |
| 3,768,642 | 10/1973 | Hansen et al. | 206/321 |
| 4,177,895 | 12/1979 | Shelton | 206/497 |
| 4,555,017 | 11/1985 | Blackmore | 206/83.5 |
| 4,793,490 | 12/1988 | Evert | 206/499 |
| 4,907,397 | 3/1990 | Goodman | 53/540 |
| 5,111,931 | 5/1992 | Gombos et al. | 206/83.5 |

*Primary Examiner*—David T. Fidei
*Attorney, Agent, or Firm*—Ted C. Gillespie

[57] ABSTRACT

An insulation shipping package for compressible insulation products comprises at least two insulation package units, the insulation shipping package having a ratio of major face edge dimensions less than about 1:1.5, the insulation products being compressed to a greater extent in the insulation shipping package than in the units so that when the insulation shipping package is opened into individual units, each individual unit has two generally rectangular major faces and a ratio of major face edge dimensions less than about 1:1.5.

22 Claims, 3 Drawing Sheets

CARTWHEELABLE SHIPPING PACKAGE FOR INSULATION

TECHNICAL FIELD

This invention pertains to the packaging of compressible insulation material for shipping. More particularly, this invention relates to the compression of insulation products into insulation packages, and further packaging a multiplicity of insulation packages into a shipping package.

BACKGROUND ART

Manufacturers of compressible insulation materials, such as fiberglass insulation, have developed methods for compressing the insulation material in order to reduce transportation costs from the manufacturing site to the housing construction job site. The insulation batts are packaged into an insulation package, such as a bag of batts. Each bag contains a number of insulation batts, with the number depending on the thickness of the insulation batts. Several bags of insulation are compressed into a unit surrounded by a sleeve of plastic material. This unitizing of the bags into a single unit enables further compression of the batts for freight savings, and facilitates the handling of several bags at once. Not only are freight savings realized, but storage efficiencies by the customer are also realized because of the high level of compression of the insulation batts and the ability to stack units on top of each other.

In a desire to provide even greater freight and storage savings, it has been proposed to combine one or more units into a larger shipping package. While the shipping package of several units provides freight and storage advantages, it is not easily handled without mechanical equipment, i.e., it is difficult for the insulation contractor to move the shipping package by hand. It has been found that the shipping package must have a relatively square face in order for it to be manually turned end over end or "cartwheeled" from one location to another. It has been found that if the major face of the shipping package is rectangular with one of the edge dimensions substantially larger than the other edge dimension, the package is not readily manually cartwheelable by an installer, and therefore does not meet the customer's fitness-for-use requirements.

Even when a shipping package is designed so that it is cartwheelable by making the major face substantially square, another problem faced by the insulation contractor is that once the shipping package is broken down into the individual units, the units themselves are not cartwheelable because they are typically a slice or fraction of the size of the shipping package, and therefore have generally elongated rectangular major faces.

DISCLOSURE OF THE INVENTION

The invention enables the shipping of a highly compressed package which can be broken down into smaller units, with both the shipping package and the units themselves being capable of being cartwheeled by an individual installer or insulation contractor. In order for the package to be cartwheelable, the length dimension and the width dimension of the shipping package must be nearly equal. If the two dimensions are unequal, the installer will be unable to lift the long side to cartwheel the package.

In order to make the package length and width nearly equal, the shipping package must be highly compressed, but with a feature that the units themselves, when released from the shipping package, will expand to a greater width so that the unit itself is also cartwheelable. By having a cartwheelable insulation shipping package that can be opened up into units which are still cartwheelable, the insulation contractor will be getting a great product quality feature.

According to this invention, there is provided an insulation shipping package for compressible insulation products, the insulation shipping package having two units, each unit comprising at least two insulation packages, the insulation shipping package having a ratio of major face edge dimensions less than about 1:1.5, the insulation products being compressed to a greater extent in the insulation shipping package than in the units so that when the insulation shipping package is opened into individual units, each individual unit has two generally rectangular major faces and a ratio of major face edge dimensions less than about 1:1.5. Preferably the ratio of the major face edge dimensions for the insulation shipping package is less than about 1:1.3, and most preferably less than about 1:1.2.

In a specific embodiment of the invention, the ratio of the major face edge dimensions for each individual unit is less than about 1:1.3, and most preferably, less than about 1:1.2.

The insulation packages can be either bags of batts or rolls of insulation material. The bags or rolls can be held together in units by either sleeves or bands or any other suitable material.

BEST MODE OF CARRYING OUT THE INVENTION

The description and the drawings disclose packages of compressible fiberglass insulation, with the insulation visible through the end of the package. It should be understood that the insulation material can be any compressible insulation material, such as rock wool, and that the insulation packages are normally closed to protect the insulation during shipping and storage.

Figure 1:
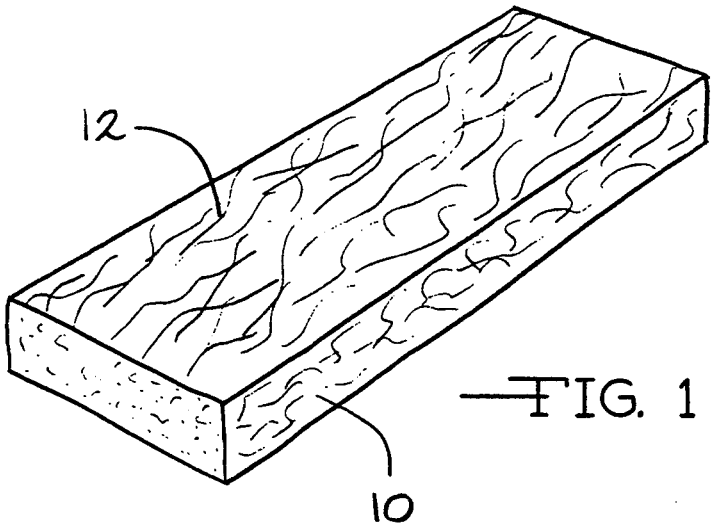
FIG. 1 is a schematic perspective view of an insulation batt.

As shown in FIG. 1, insulation batt 10 has major face 12. The insulation batt is made of glass fibers, and has a resiliency enabling it to be compressed during packaging to the extent of a ratio of at least 4:1, with recovery after the package is opened. Typical glass fiber insulation batts have a density of approximately 0.5 pounds per cubic foot. Batts are typically 4 feet or 8 feet in length. If 8 feet in length, they are usually folded in half prior to packaging.

Figure 2:
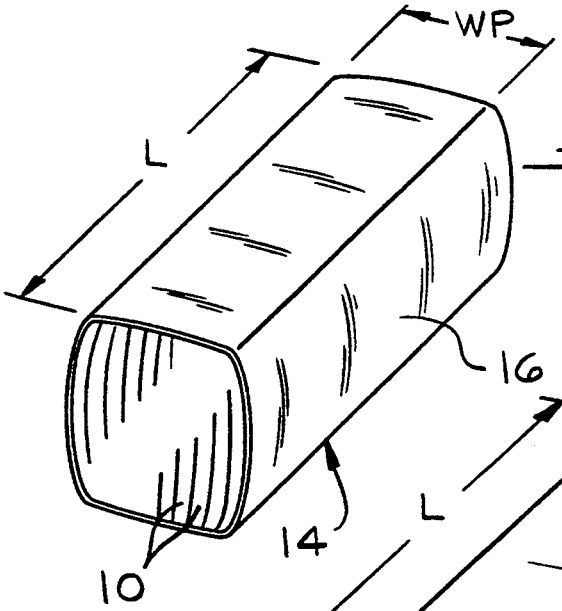
FIG. 2 is a schematic view of an insulation package which is a bag of batts.

As shown in FIG. 2, insulation package 14 is comprised of a collection of batts, with the batts packaged by wrapper 16. The wrapper can be any suitable means for holding the batts in compression. Typically the wrapper is a polyethylene film, with a thickness of about 4 mils, although other materials, such as kraft paper can be used. The batt package has a length L, which is typically about 49 inches, and a width, WP, which varies depending upon the number of the batts in the batt package, the thickness of the batts, and the extent of the compression of the batts.

Figure 3:
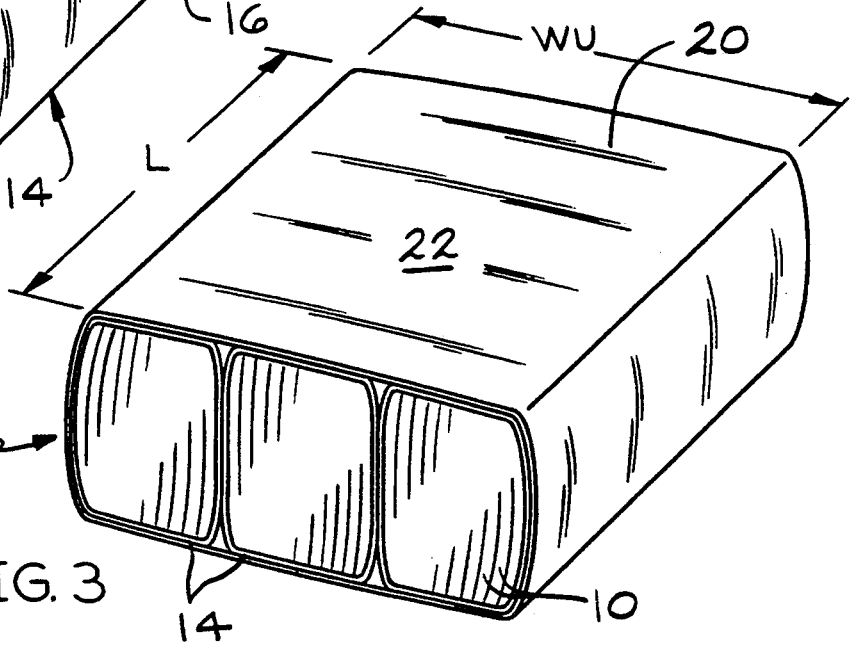
FIG. 3 is a schematic view of a unit comprising three bags of batts.

As shown in FIG. 3, three insulation packages or batt packages are unitized or held in place into unit 18 by the compression force of unit sleeve 20. The sleeve can be any means suitable for holding together two or more batt packages. Such sleeves are known in the insulation packaging field, and are typically made from polypropylene.

The unit has a length L and a width WU defining major face 22 of the unit. The ratio of the major face edge dimensions (L and WU) is less than about 1:1.5 so that the major face of the unit will be generally rectangular, preferably square, and be more easily cartwheelable. Use of the term "rectangular" includes square packages. Preferably, the ratio of major face edge dimensions of the unit will be less than about 1:1.3, and most preferably less than about 1:1.2. The more square the unit, the more easily cartwheeled the unit is by the insulation contractor.

Figure 4:
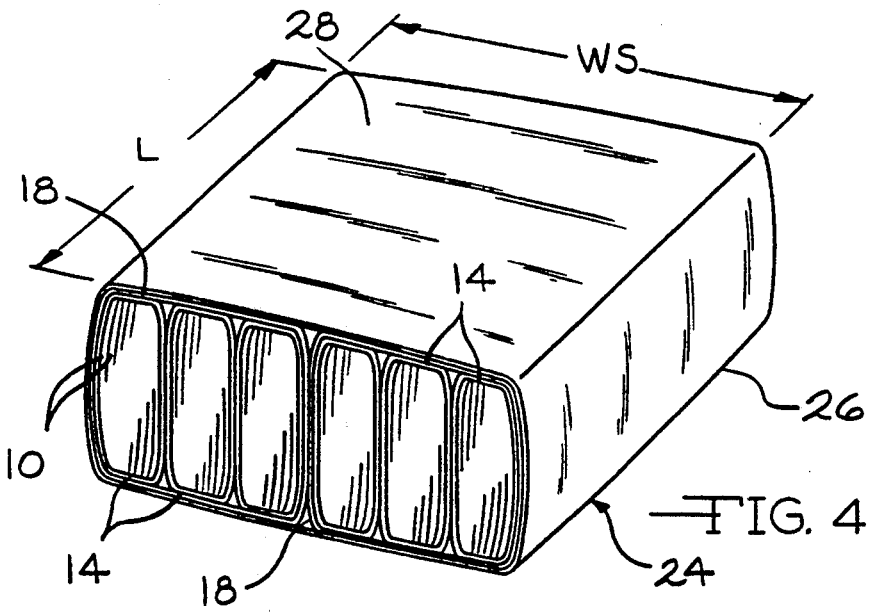
FIG. 4 is a schematic view of a shipping package comprising two units, each unit comprising three bags of batts.

As shown in FIG. 4, shipping package 24 contains two units of insulation packages. The two units are bound together by any suitable means, such as shipping package sleeve 26. Preferably, the sleeve is a polypropylene film, as is known in the field.

Major face 28 of the shipping package is generally rectangular, and preferably square. The ratio of the length of the shipping package L to the width of the shipping package WS is less than about 1:1.5, preferably less than about 1:1.3, and most preferably less than about 1:1.2. The more square the major face of the shipping package, the more easily cartwheelable will be the shipping package.

The shipping package provides great compression of the insulation batts, and this gives advantages in shipping and in storage of the product. At some point, the shipping package is broken down into the individual units by removing the shipping package sleeve. At that time the individual units partially expand so that the width of the unit grows to a distance comparable to the width of the shipping package, thereby preferably creating a unit having a generally square major face to enable the unit to be cartwheelable.

Figure 5:
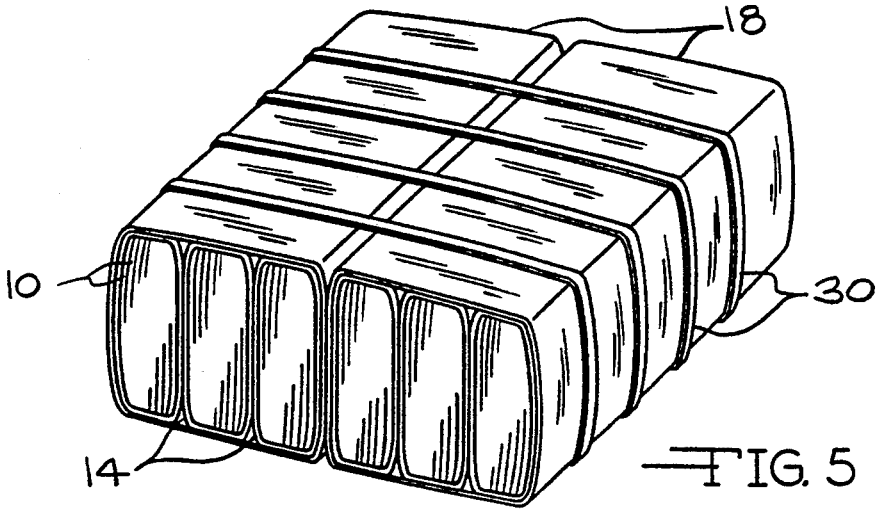
FIG. 5 is a schematic view of a shipping package held together with bands rather than a sleeve.

As shown in FIG. 5, shipping package 24A is comprised of two units of insulation packages held together by bands 30 instead of a sleeve.

Figure 6:
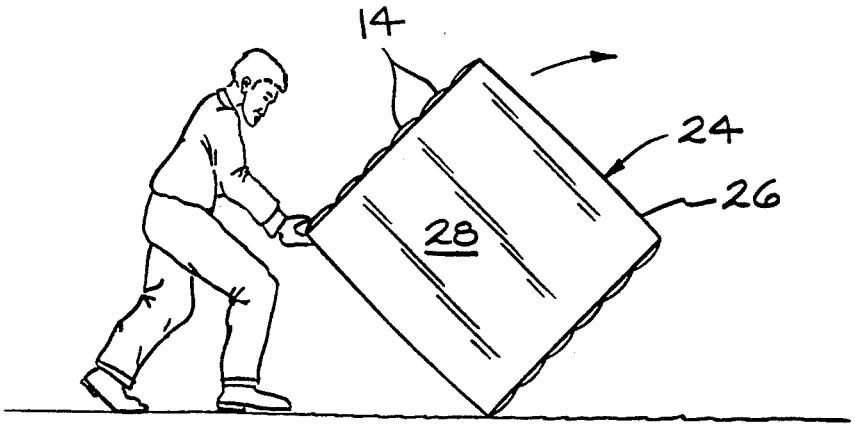
FIG. 6 illustrates an installer cartwheeling a shipping package.

As shown in FIG. 6, by providing the major face 28 of the shipping package with a generally square configuration, the shipping package can be readily cartwheeled by the insulation contractor.

Figure 7:
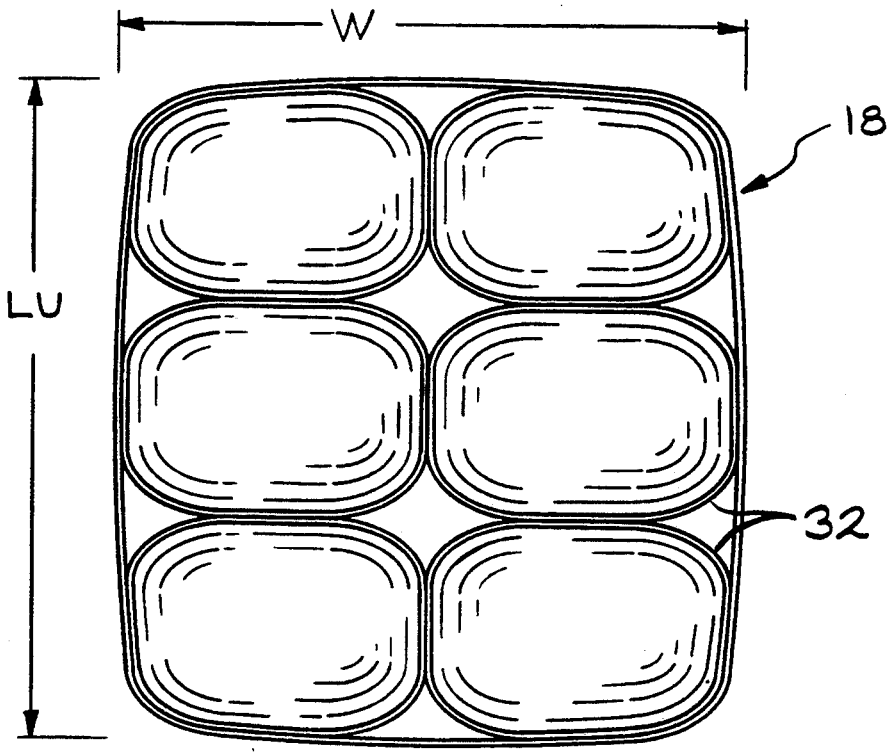
FIG. 7 is a schematic plan view of a unit of six rolls of insulation.
Figure 8:
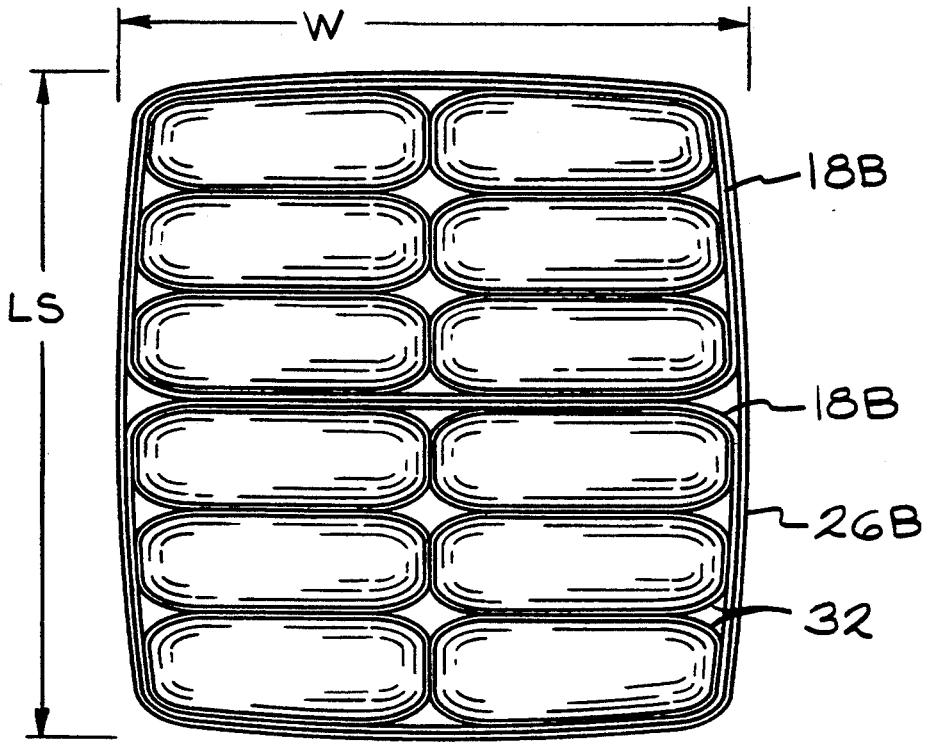
FIG. 8 is a schematic plan view of a shipping package containing two of the units illustrated in FIG. 7.

As shown in FIGS. 7 and 8, shipping package 24B can be comprised of two units 18B of rolls of insulation 32. The width W of the shipping package and the units is generally constant. Also, the length of the shipping package LS is generally equivalent to the width of the shipping package, at least to the extent that the ratio of the major face edge dimensions is less than about 1:1.5, preferably less than about 1:1.3, and most preferably less than about 1:1.2. Even after opening shipping package sleeve 26B, the expansion of the unit to length LU results in a length and width of the unit roughly equal to each other, so that the unit itself is still cartwheelable.

It should be understood that any reasonable number of insulation packages can be collected together into a unit, and any number of units can be held together as a shipping package. For example, two units, each having four bags of batts can be combined to form a shipping package containing a total of eight bags of batts.

EXAMPLE

In an example of the invention, insulation packages, each having eight folded 8-foot R19 batts were assembled. Each batt was nominally 6 inches high after unpackaging and after recovery, and about 23 inches wide. The packages had a length of approximately 51 inches and a width of approximately 20 inches.

Three of the batt packages were combined into a unit and secured with a sleeve. The unit had a length of approximately 51 inches and a width of approximately 44 inches. The ratio of the major face edge dimensions of the units was approximately 1:1.15. Two units were combined into one shipping package and secured with a sleeve. The shipping package had a length of approximately 51 inches and a width of approximately 44 inches. The ratio of the major face edge dimensions of the shipping package was 1:1.15.

It will be evident from the foregoing that various modifications can be made to this invention. Such, however, are considered as being within the scope of the invention.

I claim:

1. An insulation shipping package for compressible insulation products, the insulation shipping package having two generally rectangular major faces, defined by shipping package major face edges having length and width edge dimensions, and comprising at least two units, each unit comprising at least two insulation packages, the insulation shipping package having a ratio of major face edge dimensions less than about 1:1.5, the insulation products being compressed to a greater extent in the insulation shipping package than in the units so that when the insulation shipping package is opened into individual units, each individual unit has two generally rectangular major faces, defined by unit major face edges having length and width edge dimensions, and each unit has a ratio of major face edge dimensions less than about 1:1.5.

2. The insulation shipping package of claim 1 in which the insulation shipping package is held together by a sleeve.

3. The insulation shipping package of claim 1 in which the ratio of major face edge dimensions for the insulation shipping package is less than about 1:1.3.

4. The insulation shipping package of claim 3 in which the ratio of major face edge dimensions for each individual unit is less than about 1:1.3.

5. The insulation shipping package of claim 3 in which the ratio of major face edge dimensions for the shipping package is less than about 1:1.2.

6. The insulation shipping package of claim 1 in which the ratio of major face edge dimensions for each individual unit is less than about 1:1.3.

7. The insulation shipping package of claim 6 in which the ratio of major face edge dimensions for each individual unit is less than about 1:1.2.

8. The insulation shipping package of claim 1 in which each unit contains at least three insulation packages.

9. The insulation shipping package of claim 8 in which the insulation packages contain batts with parallel major faces.

10. The insulation shipping package of claim 8 in which the insulation packages comprise rolls of insulation.

11. The insulation shipping package of claim 1 in which the insulation shipping package is held together by bands.

12. An insulation shipping package for compressible insulation products, the insulation shipping package having two generally rectangular major faces, defined by shipping package major face edges having length and width edge dimentions, and comprising at least two units, each unit comprising at least two insulation packages, the insulation shipping package having a ratio of major face edge dimensions less than about 1:1.5, the insulation products being compressed to a greater extent in the insulation shipping package than in the units so that when the insulation shipping package is opened into individual units, each individual unit expands so that it has two generally rectangular major faces, defined by unit major face edges having length and width edge dimentions, and each unit has a ratio of major face edge dimensions less than about 1:1.5.

13. The insulation shipping package of claim 12 in which the insulation shipping package is held together by a sleeve.

14. The insulation shipping package of claim 12 in which the ratio of major face edge dimensions for the insulation shipping package is less than about 1:1.3.

15. The insulation shipping package of claim 14 in which the ratio of major face edge dimensions for each individual unit is less than about 1:1.3.

16. The insulation shipping package of claim 14 in which the ratio of major face edge dimensions for the shipping package is less than about 1:1.2.

17. The insulation shipping package of claim 12 in which the ratio of major face edge dimensions for each individual unit is less than about 1:1.3.

18. The insulation shipping package of claim 17 in which the ratio of major face edge dimensions for each individual unit is less than about 1:1.2.

19. The insulation shipping package of claim 12 in which each unit contains at least three insulation packages.

20. The insulation shipping package of claim 19 in which the insulation packages contain batts with parallel major faces.

21. The insulation shipping package of claim 19 in which the insulation packages comprise rolls of insulation.

22. The insulation shipping package of claim 12 in which the insulation shipping package is held together by bands.

* * * * *